US007012059B2

(12) United States Patent
Baines et al.

(10) Patent No.: US 7,012,059 B2
(45) **Date of Patent: *Mar. 14, 2006**

(54) FABRIC DETERGENT COMPOSITIONS

(75) Inventors: Fiona Louise Baines, Chester (GB); Timothy David Finch, Wirral (GB); Emily Jane Peckham, Chester (GB); Stephane Patrick Roth, Wirral (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 184 days.

This patent is subject to a terminal disclaimer.

(21) Appl. No.: 10/457,232

(22) Filed: Jun. 9, 2003

(65) Prior Publication Data

US 2003/0228993 A1 Dec. 11, 2003

(30) Foreign Application Priority Data

Jun. 10, 2002 (GB) ..... 0213263

(51) Int. Cl.
*C11D 1/836* (2006.01)

(52) U.S. Cl. ..... 510/506; 510/505; 510/522; 510/527

(58) Field of Classification Search ..... 510/522, 510/527, 505, 506
See application file for complete search history.

(56) References Cited

U.S. PATENT DOCUMENTS

| | | | | |
|---|---|---|---|---|
| 4,639,321 | A | 1/1987 | Barrat et al. | |
| 5,286,476 | A * | 2/1994 | Nanba et al. | 424/47 |
| 5,447,643 | A | 9/1995 | Kelkenberg et al. | |
| 5,525,245 | A | 6/1996 | Grandmaire et al. | |
| 5,723,426 | A | 3/1998 | Zhen et al. | |
| 5,759,208 | A | 6/1998 | Zhen et al. | |
| 5,880,086 | A | 3/1999 | Weinelt et al. | |
| 6,071,975 | A * | 6/2000 | Halloran | 516/58 |
| 6,436,896 | B1 * | 8/2002 | Charlton et al. | 510/527 |

FOREIGN PATENT DOCUMENTS

| | | |
|---|---|---|
| DE | 196 23 674 | 12/1996 |
| EP | 0 691 396 | 1/1996 |
| EP | 0 829 531 | 3/1998 |
| WO | 94/19439 | 1/1994 |
| WO | 96/15213 | 5/1996 |
| WO | 98/16538 | 4/1998 |
| WO | WO 98/23808 * | 6/1998 |
| WO | 01/46360 | 6/2001 |
| WO | 01/46361 | 6/2001 |
| WO | 01/46513 | 6/2001 |

OTHER PUBLICATIONS

International Search Report No. 03/04409 dated Sep. 10, 2003, 4 pages.
UK Search Report No. GB 0213263.7 dated Nov. 14, 2002, 1 page.

* cited by examiner

*Primary Examiner*—John R. Hardee
(74) *Attorney, Agent, or Firm*—Alan A. Bornstein

(57) ABSTRACT

A liquid detergent formulation comprising:
a) an effective amount of a nonionic/cationic surfactant system, and,
b) not more than 10% wt of a lubricant oil.

8 Claims, No Drawings

FABRIC DETERGENT COMPOSITIONS

TECHNICAL FIELD

The present invention relates to fabric detergent compositions, which can mitigate wrinkling in fabrics and, more particularly to detergent compositions which comprise one or more oily sugar derivatives.

BACKGROUND OF THE INVENTION

The technical difficulties which arise in the laundering of clothes can be classed into two groups. First there are the difficulties which become manifest in a single wash, and second there are those which only become apparent after a plurality of 'wash-and-wear' cycles. In the first group are found problems such as wrinkling of the clothes, whereas in the second are found problems of progressive colour loss and mechanical damage.

Our co-pending patent application GB 0030177.0 relates to the use of a lubricant during the laundering process to prevent the visible appearance of local colour loss through a build-up of mechanical damage during repeated laundering. As will be appreciated, the extent to which this damage will occur is significantly Influenced by the wash conditions. For machine-washing conditions can be classed into two broad types. In so-called 'European' washing machines the axis of rotation of the machine is generally horizontal and relatively low levels of water (typical liquor to cloth ratios below 10:1) and high temperatures are used (typically at or above 40 Celsius). In so-called 'US' washing machines, the axis of the machine is vertical and relatively high levels of water (typically above 15:1) and lower temperatures (typically below 40 Celsius) are used. US washing conditions also include tumble drying to a greater extent and this can lead to more damage from this source. A further important difference between the US and the European laundry markets is that in the US the majority of main-wash products are liquids whereas solid products (powders and tablets) are more commonplace in Europe.

Suitable lubricants disclosed in GB 00301377 include: polyacrylate salts, polyacrylic acids, polyacrylamides, copolymers of these various acrylic materials, dextrans, poly vinyl pyrrolidones, poly-dimethyl siloxanes, and, lightly oxidised polyethylene wax.

Oily sugar derivatives were first proposed as lubricating oils for aircraft engines. Due to their lubricant properties and indigestibility they have since been exploited as "fat replacers" in foodstuffs. They are also known in fabric softener compositions. Typically these materials are the products obtainable by esterification of a sugar, such as a saccharide (or other cyclic polyol), with a fatty material. These materials are non-toxic and inherently biodegradable and will be referred to herein as sugar polyesters ("SPE's"). As noted above SPE's have been proposed for use in fabric conditioners and/or softeners.

U.S. Pat. No. 5,447,643 (Huls) discloses aqueous fabric softeners comprising nonionic surfactants. Suitable nonionic surfactants include materials with one to four long hydrophobic chains and a glucose or polysaccharide radical.

WO 96/15213 (Henkel) discloses fabric softening agents containing alkyl, alkenyl and/or acyl group containing sugar derivatives, which are solid after esterification, in combination with nonionic and cationic emulsifiers.

WO 98/16538 (Unilever) discloses rinse-added fabric softening compositions comprising liquid or soft solid derivatives of a cyclic polyol or a reduced saccharide which give good softening and retain absorbency of the fabric.

WO 01/46513 (Unilever) relates to fabric treatment compositions which comprise an oily sugar derivative and one or more deposition aids. The benefit obtained by the use of these compositions is to reduce wrinkling of the fabrics and therefore reduce the need for ironing. The deposition aids are selected from cationic surfactants, cationic softeners, cationic polymers and mixtures thereof. Nonionic surfactants (including alcohol ethoxylate with an HLB of from 11 to 16) are optional ingredients. Example 3 of that specification disclose a (phosphate) built, main wash composition with 3% cationic surfactant (CTAB), 18% nonionic surfactant (C11–13, 3–7EO) and 15% sucrose poly erucate.

BRIEF DESCRIPTION OF THE INVENTION

We have now determined that the incorporation of relatively low levels of lubricants in a unbuilt or poorly built liquid main-wash product suitable for use in US-type washing conditions gives both a softening and an anti-wrinkle benefit following the wash. It is believed that this is a consequence of lubrication which is further believed to lead to anti-wrinkle, softening and ease of ironing behaviour, as well as a reduction in longer-term fabric damage, leading to pilling etc.

According to the present invention there is provided a liquid detergent formulation comprising:

a) an effective amount of a nonionic/cationic surfactant system, and, b) not more than 10% wt of a lubricant oil, Conveniently, the compositions comprise a level of builder such that the calcium binding capacity of the composition does not exceed that of an equivalent composition which comprises 10%, preferably 7%, more preferably 5% by wt of sodium tripolyphosphate as sole builder. Nonionic/cationic formulations have been found to reduce dye transfer. It is believed that this is due to the reduced level of dye-stripping (especially fixed, direct dyes) for nonionic and cationic compositions as compared with anionic compositions. It is believed that this benefit is decreased on the addition of soluble builder as such builders are a significant contributor to ionic strength. Insoluble builders do not contribute to ionic strength to the same extent, but make formulation of clear products difficult.

Preferably, compositions according to the invention are essentially free of anionic surfactants. Small amounts of anionic can be tolerated but the level should be significantly below that of the cationic surfactant.

Preferred lubricants include polyol polyesters, polyol polyethers and silicone (particularly amino-silicone) polymers. Polyol polyesters, particularly oily sugar derivatives, more particularly SPE materials, are most preferred as they are inherently biodegradable.

The compositions according to invention are preferably transparent liquids (which expression is intended to include gels).

According to a further aspect of the present invention there is provide a process for the manufacture of a fabric washing composition according to the first aspect of the present invention which comprises the steps of:

a) mixing a lubricant/solvent premix with a cationic surfactant to form a further premix, b) mixing the further premix with a nonionic surfactant.

We have determined that this method produces a composition which is more effective at delivering the lubricant to the fabric.

DETAILED DESCRIPTION OF THE INVENTION

In order that the invention may be further understood it is described in further detail below with reference to preferred features of the invention.

Compositions according to the invention are liquids and are preferably clear rather than opaque.

Lubricants:

As noted above the preferred lubricants are polyol polyesters, particularly oily sugar derivatives. In the context of the present specification the term 'oil' is intended to embrace both viscous liquids and soft solids.

The preferred oily sugar derivatives are liquid or soft solid derivatives of a cyclic polyol or of a reduced saccharide, said derivatives resulting from 35 to 100% of the hydroxyl groups in said polyol or in said saccharide being esterified or etherified. The derivative has two or more ester or ether groups independently attached to a C8–C22 alkyl or alkenyl chain.

The oily sugar derivatives of the invention are also referred to herein as "derivative-CP" and "derivative-RS" dependent upon whether the derivative is a product derived from a cyclic polyol ('CP') or from a reduced saccharide ('RS') starting material respectively.

Preferably the derivative-CP and derivative-RS contain 35% by weight tri or higher esters, e.g. at least 40%.

Preferably 35 to 85% most preferably 40 to 80%, even more preferably 45 to 75%, such as 45 to 70% of the hydroxyl groups in said cyclic polyol or in said reduced saccharide are esterified or etherified to produce the derivative-CP and derivative-RS respectively.

For the derivative-CP and derivative-RS, the tetra, penta etc prefixes only indicate the average degrees of esterification or etherification.

The compounds exist as a mixture of materials ranging from the monoester to the fully esterified ester. It is the average degree of esterification as determined by weight that is referred to herein.

The derivative-CP and derivative-RS used do not have substantial crystalline character at 20° C. Instead they are preferably in a liquid or soft solid state, as hereinbelow defined, at 20° C.

The starting cyclic polyol or reduced saccharide material is esterified or etherified with C8–C22 alkyl or alkenyl chains to the appropriate extent of esterification or etherification so that the derivatives are in the requisite liquid or soft solid state. These chains may contain unsaturation, branching or mixed chain lengths.

Typically the derivative-CP or derivative-RS has 3 or more, preferably 4 or more, more particularly 4 to 5, ester or ether groups or mixtures thereof.

The alkyl or alkenyl groups may be branched or linear carbon chains.

In the context of the present invention the terms derivative-CP and derivative-RS encompass all ether or ester derivatives of all forms of saccharides, which fall into the above definition. Examples of preferred saccharides for the derivative-CP and derivative-RS to be derived from are monosaccharides and disaccharides.

Examples of monosaccharides include xylose, arabinose, galactose, fructose, sorbose and glucose. Glucose is especially preferred. An example of a reduced saccharide is sorbitan. Examples of disaccharides include maltose, lactose, cellobiose and sucrose.

Sucrose is especially preferred.

If the derivative-CP is based on a disaccharide it is preferred if the disaccharide has 3 or more ester or ether groups attached to it. Examples include sucrose tri, tetra and penta esters.

Examples of suitable derivative-CPs include esters of alkyl (poly) glucosides, in particular alkyl glucoside esters having a degree of polymerisation from 1 to 2.

The HLB of the derivative-CP and derivative-RS is typically between 1 and 3.

The derivative-CP and derivative-RS may have branched or linear alkyl or alkenyl chains (with varying degrees of branching), mixed chain lengths and/or unsaturation. Those having unsaturated and/or mixed alkyl chain lengths are preferred.

One or more of the alkyl or alkenyl chains (independently attached to the ester or ether groups) may contain at least one unsaturated bond.

For example, predominantly unsaturated fatty chains may be attached to the ester/ether groups, e.g. those attached may be derived from rapeseed oil, cotton seed oil, soybean oil, oleic acid, tallow acid, palmitoleic acid, linoleic acid, erucic acid or other sources of unsaturated vegetable fatty acids.

The alkyl or alkenyl chains of the derivative-CP and derivative-RS are preferably predominantly unsaturated, for example sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose trioleate, glucose tetraoleate, xylose trioleate, or sucrose tetra-,tri-, penta- or hexa-esters with any mixture of predominantly unsaturated fatty acid chains.

However some derivative-CPs and derivative-RSs may be based on alkyl or alkenyl chains derived from polyunsaturated fatty acid sources, e.g. sucrose tetra-linoleate. It is preferred that most, if not all, of the polyunsaturation has been removed by partial hydrogenation if such polyunsaturated fatty acid chains are used.

The most highly preferred liquid or soft solid derivative CPs and derivative-RSs are any of those mentioned in the above three paragraphs but where the polyunsaturation has been removed through partial hydrogenation.

Particularly effective derivative-CPs and derivative-RSs are obtained by using a fatty acid mixture (to react with the starting cyclic polyol or reduced saccharide) which comprises a mixture of tallow fatty acid and oleyl fatty acid in a weight ratio of 10:90 to 90:10, more preferably 25:75 to 75:25, most preferably 30:70 to 70:30. A fatty acid mixture comprising a mixture of tallow fatty acid and oleyl fatty acid in a weight ratio of 60:40 to 40:60 is especially preferred.

Particularly preferred are fatty acid mixtures comprising a % weight ratio of approximately 50wt % tallow chains and 50 wt % oleyl chains. It is especially preferred that the fatty acid feedstock for the chains consists of only tallow and oleyl fatty acids.

Preferably 40% or more of the chains contain an unsaturated bond, more preferably 50% or more, most preferably 60% or more e.g. 65% to 95%.

Oily sugar derivatives suitable for use in the compositions include sucrose pentalaurate, sucrose tetraoleate, sucrose pentaerucate, sucrose tetraerucate, and sucrose pentaoleate and the like. Suitable materials include some of the Ryoto series available from Mitsubishi Kagaku Foods Corporation.

The liquid or soft solid derivative-CPs and derivative-RSs are characterised as materials having a solid:liquid ratio of between 50:50 and 0:100 at 200° C. as determined by T2 relaxation time NMR, preferably between 43:57 and 0:100, most preferably between 40:60 and 0:100, such as, 20:80 and 25:100. The T2 NMR relaxation time is commonly used for characterising solid:liquid ratios in soft solid products such as fats and margarines. For the purpose of the present invention, any component of the NMR signal with a T2 Of less than 100 microseconds is considered to be a solid component and any component with T2 greater than 100 microseconds is considered to be a liquid component.

The liquid or soft solid derivative-CPs and derivative-RSs can be prepared by a variety of methods well known to those skilled in the art. These methods include acylation of the cyclic polyol or of a reduced saccharide with an acid chloride; trans-esterification of the cyclic polyol or of a reduced saccharide material with short chain fatty acid esters in the presence of a basic catalyst (e.g. KOH); acylation of the cyclic polyol or of a reduced saccharide with an acid anhydride, and, acylation of the cyclic polyol or of a reduced saccharide with a fatty acid. Typical preparations of these materials are disclosed in U.S. Pat. No. 438,615,213 and AU 14416/88 (Procter and Gamble).

The compositions preferably comprise between 0.5%–20% wt of the oily sugar derivatives, more preferably 1–10% wt, most preferably 3–8% wt. based on the total weight of the composition. A suitable sucrose polyester is 'Ryoto ER-290' (ex. Mitsubishi). This material has an average esterification ratio of from 4–5 Moles of fatty chain (derived from erucic acid) per mole of sucrose.

Solvent:

Typically the compositions according to the invention will further comprise a solvent. Preferred incorporation levels of solvent are 3–10% wt. Suitable solvents are polar non-aqueous solvents. Preferred solvents include, glycols, glycol-ethers, and alcohols. Ethanol is a particularly suitable solvent and may be used in the form of 'methylated spirits'.

Given that the preferred SPE lubricant is a viscous material it is advantageous to pre-mix the solvent with the SPE.

Cationic Surfactant:

The compositions may comprise one or more cationic surfactants. These partly function as a deposition aid for the lubricant. However they also have a cleaning function.

These surfactants preferably have a single C8–C28 alkyl or alkenyl chain, more preferably a single C8–C20 (fatty) alkyl or alkenyl chain, most preferably a single C10–C18 alkyl or alkenyl chain. Where the cationic surfactants are simple quaternary ammonium compounds the remaining three chains are short chain C1–C3 alkyl or hydroxyalkyl, preferably methyl or hydroxyethyl. These single chain cationic surfactants facilitate the formulation of clear compositions whereas those having two or more fatty alkyl chains are more difficult to formulate into clear compositions.

Suitable cationic surfactants include water-soluble single long-chain quaternary ammonium compounds such as cetyl trimethyl ammonium chloride, cetyl trimethyl ammonium bromide, or any of those listed in European Patent No. 258 923 (Akzo).

The cationic surfactant may be an alkyl tri-methylammonium methosulphate or chloride or alkyl ethoxylalkyl ammonium methosulphate or chloride. Examples include coconut pentaethoxymethyl ammonium methosulphate and derivatives in which at least two of the methyl groups on the nitrogen atom are replaced by (poly)alkoxylated groups. Preferably, the cation in the cationic surfactant is selected from alkyl tri-methylammonium methosulphates and their derivatives, in which, at least two of the methyl groups on the nitrogen atom are replaced by (poly)alkoxylated groups.

Any suitable counter-ion may be used in the cationic surfactant.

Preferred counter-ions for the cationic surfactants include halogens (especially chlorides), methosulphate, ethosulphate, tosylate, phosphate and nitrate.

Suitable commercially available cationic surfactants include the Ethoquad range from Akzo, e.g. Ethoquad 0/12 and Ethoquad HT/25.

The most preferred cationic surfactants are fatty dimethyl hydroxy ethyl or fatty trimethyl ammonium salts. Suitable examples of these materials are Praepagen HY™ (fatty alkyl dimethyl hydroxy-ethyl ammonium chloride, ex Clariant) and Servamine KAC™ (dodecyl trimethyl ammonium chloride, ex Condea).

The cationic surfactant is preferably present in an amount of 1 to 10% by weight, more preferably 3–8% wt of the total composition. Levels of cationic below 3% wt are less effective.

We have found it advantageous to form a premix of the cationic surfactant with the preferred SPE/solvent mixtures. As will be discussed in further detail below this has the advantage that it improves the deposition of the SPE.

Nonionic Surfactants:

Preferably the nonionic surfactant has a single C8–C28 alkyl or alkenyl chain, more preferably a single C8–C20 alkyl or alkenyl chain, most preferably a single C10–C18 alkyl or alkenyl chain.

Suitable nonionic surfactants include the condensation products of primary or secondary linear or branched alcohols preferably C8–C30 alcohols, more preferably C10–C22 alcohols, alkoxylated with 4–12 moles of alkylene oxide, preferably 5–9 moles of alkylene oxide. Preferably the alkylene oxide is ethylene oxide although it may be/include propoxylate groups. The alcohols may be saturated or unsaturated.

Suitable alcohol ethoxylates include C12–14 5–9EO materials such as those available in the marketplace as Surfonic™ L24–5 and L24–9 (linear alcohol ethoxylates C12–14, 5 or 9 EO, ex Huntsman). The lower levels of ethoxylation are preferred as these are expected to give better detergency.

The nonionic surfactant is preferably present in an amount of 10 to 30% by weight, more preferably 12–25% wt.

Other Ingredients:

The compositions of the invention preferably have a pH above 7, more preferably from 8 to 11, most preferably 9–10. Borax (which buffers around 9.2) is a suitable buffer to achieve this pH.

It is envisaged that compositions will typically comprise a perfume of a type conventionally used in detergent compositions or fabric softening compositions. It is advantageous to include the perfume in the SPE to improve processing. Deposition of the lubricant containing the perfume is expected to prolong perfume release.

It may be advantageous if a viscosity control agent (to achieve a viscosity that is desired by the consumer) is present. These agents may also help to improve the stability of the compositions, for example by slowing down, or stopping, the tendency of the composition to separate. Any such agent conventionally used in detergent compositions or rinse conditioners may be used. For example synthetic polymers e.g. polyacrylic acid, poly vinyl pyrrolidone, carbomers, and polyethylene glycols may be used.

Other polymers may also be included in the compositions. Suitable polymers include nonionic polymers such as PLURONICSO (ex BASF), dialkyl PEGs, cellulose derivatives as described in GB 213 730 (Unilever), hydroxy ethyl cellulose, starch, and hydrohobically modified nonionic polyols such as ACUSOLO 880/882 (ex Rohm & Haas). The nonionic polymer may be present in the compositions in an amount of 0.01–5% by weight based upon the total weight of the composition, more preferably 0.02–2.5%, such as 0.05–2%.

The composition may also contain one or more optional ingredients conventionally used in detergent compositions, selected from dyes, preservatives, antifoams, fluorescers, hydrotropes, antiredeposition agents, enzymes, optical brightening agents, opacifiers, anti-shrinking agents, anti-spotting agents, germicides, fungicides, anti-corrosion agents, drape imparting agents, antistatic agents, sunscreens, skincare and colour care agents.

The fabrics which are to be treated with the compositions described herein may be treated by any suitable laundering method. The preferred methods are by treatment of the fabric during a domestic laundering process conducted in a so-called 'US' type machine and/or under a 'US' type wash condition.

In order that the invention may be further and better understood it is described below with reference to non-limiting examples.

EXAMPLES

Examples 1–8 below show that it is possible to obtain a lubrication benefit with the compositions of the invention. It is known that one effect of a lubrication benefit is to reduce wrinkling.

Examples 9–20 show that detergency is not adversely affected by the formulation of the invention.

Examples 21–26 show that the preferred cationic surfactants give a clear product.

Examples 27–31 show that the best deposition of SPE was obtained when the SPE (admixed with ethanol) was pre-mixed with the cationic.

Nonionic/cationic and nonionic only formulations were prepared by weighing the ingredients into a 250 ml beaker and mixing with a Silverson™ mixer at high shear for three minutes.

In all cases (except where otherwise stated in examples 27–31) nonionic/cationic samples with SPE were prepared as follows:

a) The nonionic, water, borax and cationic were weighed into a 250 ml beaker b) SPE/ethanol mix was weighed into a weighing boat.

c) The nonionic mix was mixed on low shear for 2 minutes using a Silverson mixer whilst the SPE/ethanol mix was slowly poured over the side.

d) The Silverson was turned up to high shear and mixed for a further 3 minutes.

In examples 27–31 the nonionic/cationic samples with SPE as made by the preferred method were prepared as follows:

a) The SPE/ethanol mix and cationic were weighed into a 50 ml beaker, b) This was mixed at high shear for 1 minute using a Silverson mixer, c) The remaining ingredients, i.e. nonionic, water, borax were weighed into a 250 ml beaker, d) The contents of the 250 ml beaker were mixed at low shear using the Silverson while the pre-emulsified cationic/SPE mix was slowly poured over the side for one minute. After 1 minute the Silverson was turned up to high shear and mixing was continued for 2 minutes.

Examples 1–8

Lubrication

Table 1 below shows the compositions used in examples 1–8. Results are given for lubrication assessments. 100% Oxford cotton monitors were five times pre-washed (in 'All'). Monitors were washed in a Tergometer (35 Celsius, 15 min at 75 rpm, 1 liter water, 40 g of fabric, rinsed once for five minutes and tumble-dried). 1.69 g/L of Wisk™ was used and otherwise 2.15 g/L of the various other compositions.

Lubrication (Kawabata Shear) measurements were carried out on four to six dried monitors which were cut to 17×17 cm squares and placed in a humidity controlled room (20° C./65% RH) for 24 hours prior to Kawabata measurements. Shear measurements were carried out according to the standard instrument manual. Testing was performed with the warp direction perpendicular to the motion of the clamping bars. The values obtained were averaged and the '2HG5' value (which corresponds to lubrication) determined. Lower values are indicative of increased lubrication.

Wisk™ was used as a comparative example. Wisk is an anionic/nonionic based US liquid detergent ex Lever Bros.

TABLE 1

| Trade Name | WISK ® (comparative) | Example 1 | Example 2 | Example 3 | Example 4 | Example 5 | Example 6 | Example 7 (comparative) | Example 8 (comparative) |
|---|---|---|---|---|---|---|---|---|---|
| CTAB (cationic) | | 5% | 2.5% | 5% | 0% | 0% | 0% | 0% | 0% |
| Praepagen HY (cationic) | | 0% | 0% | 0% | 5% | 2.5% | 5% | 0% | 0% |
| Surfonic L24-5 (nonionic) | | 15% | 20% | 25% | 15% | 20% | 25% | 25% | 15% |
| Ryoto ER-290 (SPE) | | 5% | 5% | 5% | 5% | 5% | 5% | 5% | 5% |
| Ethanol | | 5% | 5% | 5% | 5% | 5% | 5% | 5% | 5% |
| Borax | | 2.4% | 2.4% | 2.4% | 2.4% | 2.4% | 2.4% | 2.4% | 2.4% |
| Lubrication A | 6.16 | | | | 5.78 | 6.18 | 5.52 | 6.27 | |
| Lubrication B | 6.44 | 4.76 | 5.73 | 5.43 | | | | 6.17% | 6.13 |

From the results shown in Table 1 it can be seen that increased lubrication is obtained with the compositions of the invention.

Examples 9–20

Detergency

Table 2b below shows the formulations used in Examples 9–20. Table 3 shows the detergency scores obtained for these examples (plus Wisk™) on the monitor types described in table 2a. This is factorial experiment in which low and high levels of each component are selected. Products were used at a same wash concentration of 1.69 g/L (Wisk) and 2.15 g/L of the nonionic/cationic formulations as in examples 1–8. Three replicate washes were carried out for each monitor. To give the results in Table 3 least mean squares delta-E values were calculated for each treatment.

TABLE 2b

| Component | Example 9 | Example 10 | Example 11 | Example 12 | Example 13 (comparative) | Example 14 (comparative) | Example 15 (comparative) | Example 16 (comparative) | Example 17 (comparative) | Example 18 (comparative) | Example 19 (comparative) | Example 20 (comparative) |
|---|---|---|---|---|---|---|---|---|---|---|---|---|
| Surfonic L24-5 (nonionic) | 15% | 25% | 15% | 25% | 15% | 25% | 15% | 25% | 15% | 25% | 15% | 25% |
| Praepagen HY (cationic) | 0% | 0% | 5% | 5% | 0% | 0% | 0% | 0% | 5% | 5% | 0% | 0% |
| Servamine KAC (cationic) | 5% | 5% | 0% | 0% | 0% | 0% | 5% | 5% | 0% | 0% | 0% | 0% |
| Ryoto ER-290 (SPE) | 5% | 5% | 5% | 5% | 5% | 5% | 0% | 0% | 0% | 0% | 0% | 0% |
| Ethanol | 5% | 5% | 5% | 5% | 5% | 5% | 5% | 5% | 5% | 5% | 5% | 5% |
| Borax | 2.4% | 2.4% | 2.4% | 2.4% | 2.4% | 2.4% | 2.4% | 2.4% | 2.4% | 2.4% | 2.4% | 2.4% |

TABLE 2a

| Monitor types | | |
|---|---|---|
| Monitor | Fabric Type | Response |
| A | Cotton | Builder/water hardness and product concentration, (useful for medium and low temperature washes). |
| B | Cotton | Builder, water hardness and active. |
| C | Polyester/cotton | Builder, water hardness and active. |
| D | Polyester | Builder, water hardness and active. |

TABLE 3

| Detergency results | | | | |
|---|---|---|---|---|
| Example number | Monitor A | Monitor B | Monitor C | Monitor D |
| Wisk ™ (comparative) | 4.1 | 3.2 | 2.9 | 6.0 |
| 9 | 4.2 | 3.6 | 4.2 | 6.3 |
| 10 | 5.2 | 5.4 | 7.6 | 9.1 |
| 11 | 4.5 | 3.9 | 4.4 | 6.6 |
| 12 | 5.0 | 4.8 | 6.8 | 8.5 |

TABLE 3-continued

| Detergency results | | | | |
|---|---|---|---|---|
| Example number | Monitor A | Monitor B | Monitor C | Monitor D |
| 13 (comparative) | 3.4 | 2.7 | 2.9 | 3.8 |
| 14 (comparative) | 3.7 | 3.1 | 3.7 | 6.1 |
| 15 (comparative) | 4.6 | 4.1 | 6.0 | 7.8 |
| 16 (comparative) | 5.2 | 5.2 | 7.5 | 10.1 |
| 17 (comparative) | 4.8 | 4.7 | 7.4 | 8.2 |
| 18 (comparative) | 5.0 | 5.5 | 8.7 | 10.3 |
| 19 (comparative) | 3.9 | 3.1 | 3.8 | 6.4 |
| 20 (comparative) | 4.5 | 3.5 | 4.4 | 7.9 |

In Table 3, higher values of Delta-E indicate better detergency. From statistical significance and an analysis of variance in these results it is possible to conclude that the compositions do not perform significantly worse than the control (Wisk). Therefore detergency is not adversely affected.

Examples 21–26

Appearance

Samples were prepared with various cationic surfactants. The results of visual inspection after formulation are shown in Table 4 below. From these results it can be seen that clear products were obtained with the mono-fatty alkyl cationic (Praepagen, Servamine and CTAB) whereas opaque products were obtained with the di-fatty alkyl cationic.

TABLE 4

| Appearance in solution | | |
|---|---|---|
| Example | Cationic | Appearance |
| 21 | Praepagen HY | Clear |
| 22 | Servamine KAC | Clear |
| 23 | Arquad 2T | Opaque |
| 24 | Arquad 2HT | Opaque |
| 25 | CTAB | Clear or opaque dependant on composition |

Examples 27–31

Processing

Table 5 below shows results for delta-E measured with an SPE which had been marked with an SPE-soluble dye ('Oil-Red-O' ex. Aldrich). Oxford cotton samples (4 g) were used in a 250 ml glass bottle-wash in 100 mls of water containing 0.43 g of formulation, at 32 Celsius. Delta-E measurements were obtained with a Spectraflash™.

The formulation processing methods are also shown in Table 5. It can be seen for both of the cationic surfactants used the best deposition was obtained when the SPE premix was pre-emulsified with the cationic.

TABLE 5

(Mean Delta E correlates to deposition level on fabric)

| Processing Method | CTAB Mean Delta E | Praepagen HY Mean Delta E |
|---|---|---|
| Example 27: Combining all ingredients except SPE/ethanol and adding SPE ethanol while mixing | 4.97 | 6.97 |
| Example 28: Pre-emulsifying the cationic with the SPE/ethanol (described at the start of the examples section) | 7.07 | 8.17 |
| Example 29: Pre-emulsifying half the nonionic with the SPE/ethanol | 5.23 | — |
| Example 30: Forming a concentrate (one third water) then watering it down | 3.66 | 7.41 |
| Example 31: Pre-emulsifying the nonionic with the SPE/ethanol | 3.32 | — |

What is claimed is:

1. A transparent liquid detergent formulation comprising:

a) a nonionic-cationic surfactant system;

b) 0.5% to 10% wt of a lubricant selected from polyol polyester(s), polyol polyether(s), or blends thereof; and c) wherein the cationic surfactant is a quaternary ammonium compound which has a single C8–C28 alkyl or alkenyl chain, the remaining three chains being short chain C1–C3 alkyl or hydroxyalkyl and the nonionic-cationic surfactant system is present in an effective amount to function as a deposition aid for the lubricant and to also have a cleansing function.

2. A composition according to claim 1 which further comprises a polar non-aqueous solvent.

3. A liquid detergent composition according to claim 1 wherein the level of builder such that the calcium binding capacity of the composition does not exceed that of an equivalent composition which comprises 10% sodium tripolyphosphate as sole builder.

4. A composition according to claim 1 which is essentially free of anionic surfactants.

5. A composition according to claim 1 wherein the polyol polyester is an oily sugar derivative.

6. A composition according to claim 1 wherein the cationic surfactant is a fatty dimethyl hydroxy ethyl or fatty trimethyl ammonium salt.

7. A composition according to claim 1 wherein the nonionic surfactant is the condensation product of fatty, primary or secondary, linear or branched alcohol, alkoxylated with 4–12 moles of alkylene oxide.

8. A process for the manufacture of a fabric washing composition according to claim 1 which comprises the steps of:

a) mixing a lubricant/polar solvent premix with a cationic surfactant to form a further premix, and, b) mixing the further premix with a nonionic surfactant.

* * * * *